US009366110B2

(12) United States Patent
Feng et al.

(10) Patent No.: US 9,366,110 B2
(45) Date of Patent: Jun. 14, 2016

(54) MULTI-LEVEL SLIDING SLEEVE

(71) Applicant: CNPC Bohai Drilling Engineering Company Limited, Tianjin (CN)

(72) Inventors: Qiang Feng, Tianjin (CN); Jun Li, Tianjin (CN); Fei Li, Tianjin (CN); Yao Wang, Tianjin (CN); Wei Dang, Tianjin (CN); Hongjun Li, Tianjin (CN); Zhiyong He, Tianjin (CN)

(73) Assignee: CNPC Bohai Drilling Engineering Company Limited, Tianjin (CN)

( * ) Notice: Subject to any disclaimer, the term of this patent is extended or adjusted under 35 U.S.C. 154(b) by 524 days.

(21) Appl. No.: 14/019,495

(22) Filed: Sep. 5, 2013

(65) Prior Publication Data

US 2014/0182838 A1 Jul. 3, 2014

(30) Foreign Application Priority Data

Dec. 28, 2012 (CN) ..... 2012 1 0587000

(51) Int. Cl.

| | |
|---|---|
| ***E21B 34/14*** | (2006.01) |
| ***E21B 34/06*** | (2006.01) |
| ***E21B 34/10*** | (2006.01) |
| *E21B 33/12* | (2006.01) |

(52) U.S. Cl.

CPC ..... *E21B 34/14* (2013.01); *E21B 34/063* (2013.01); *E21B 34/103* (2013.01); *E21B 33/12* (2013.01)

(58) Field of Classification Search

CPC . E21B 34/14; E21B 2034/007; E21B 34/102; E21B 34/103; E21B 34/063; E21B 34/06; E21B 34/10

See application file for complete search history.

(56) References Cited

U.S. PATENT DOCUMENTS

| | | | | |
|---|---|---|---|---|
| 6,408,946 | B1 * | 6/2002 | Marshall | E21B 23/04 166/242.1 |
| 9,010,447 | B2 * | 4/2015 | Themig | E21B 34/14 166/318 |
| 2010/0212885 | A1 * | 8/2010 | Hall | E21B 23/04 166/194 |
| 2012/0111574 | A1 * | 5/2012 | Desranleau | E21B 34/14 166/373 |
| 2013/0043042 | A1 * | 2/2013 | Flores | E21B 43/26 166/373 |
| 2013/0056220 | A1 * | 3/2013 | Sommers | E21B 34/102 166/373 |
| 2013/0153220 | A1 * | 6/2013 | Carter | E21B 33/128 166/285 |
| 2013/0192846 | A1 * | 8/2013 | Garcia | E21B 34/14 166/373 |
| 2014/0048271 | A1 * | 2/2014 | Coon | E21B 34/102 166/308.1 |
| 2014/0158361 | A1 * | 6/2014 | Cheng | E21B 23/006 166/308.1 |
| 2014/0182838 | A1 * | 7/2014 | Feng | E21B 34/14 166/194 |
| 2014/0318816 | A1 * | 10/2014 | Hofman | E21B 34/14 166/386 |
| 2015/0176361 | A1 * | 6/2015 | Prosser | E21B 34/14 166/192 |

* cited by examiner

*Primary Examiner* — Daniel P Stephenson

(74) *Attorney, Agent, or Firm* — Matthias Scholl, PC; Matthias Scholl

(57) ABSTRACT

A multi-level sliding sleeve including an outer cylinder, an inner sliding sleeve, a combined ball socket, a guider, an expander, an upper gland, a lower gland, and a ball. The outer cylinder includes internal threads in an upper end and external threads in a lower end, and the outer cylinder including an external wall including a plurality of drainage holes along the peripheral direction. The inner sliding sleeve is mounted to an inner wall of the outer cylinder through shear pins. The inner sliding sleeve includes a plurality of square holes in the middle along the peripheral direction, each of which is equipped with a ball socket inside. The ball sockets combine together to form a combined ball socket. The combined ball socket is equipped with the guider in the upper end and the expander in the lower end.

4 Claims, 3 Drawing Sheets

MULTI-LEVEL SLIDING SLEEVE

CROSS-REFERENCE TO RELATED APPLICATIONS

Pursuant to 35 U.S.C. §119 and the Paris Convention Treaty, this application claims the benefit of Chinese Patent Application No. 201210587000.7 filed Dec. 28, 2012.

BACKGROUND OF THE INVENTION

1. Field of the Invention

The invention relates to an underground sliding sleeve for fracturing the oil-gas well, and more particularly to a multi-level sliding sleeve of ball-throwing open type.

2. Description of the Related Art

Staged fracturing of multi-level sliding sleeve packer is the leading technique of well completion among the staged fracturing techniques of open-hole horizontal wells, which can realize the simultaneous fracturing of several segments of the horizontal well without using the bridge plug packer. Well completion of ball-throwing sliding sleeve is a kind of completion method which can be realized through mechanical and hydraulic operations. The method enables the sliding sleeve and the expansible packer to divide the horizontal segment into several independent systems according to the geological requirements. During construction, balls will be thrown in order, and pressure is built to open the sliding sleeve, thereby connecting to the segment where the sliding sleeve is, packing the fractured segments and realizing staged fracturing.

Conventionally, the sliding sleeve is opened by the thrust force of balls. Then the balls are blocked by the ball socket, and cannot move to the next sliding sleeve with the matching size. In consequence, in the current staged fracturing techniques using multi-level sliding sleeve packer, one ball-throwing can only open the one ball-throwing sliding sleeve corresponding thereto; in the meanwhile, as limited by the ball differential, the construction tube mechanism can only carry a limited number of sliding sleeves, thereby failing to provide enough production fairways in the horizontal well with a long horizontal segment.

SUMMARY OF THE INVENTION

In view of the above-described problems, it is one objective of the invention to provide a multi-level sliding sleeve of ball-throwing open type for staged fracturing of open-hole horizontal wells. The multi-level sliding sleeve can allow the ball to pass through after the ball opens the sliding sleeve, thereby opening several multi-level sliding sleeves with one ball-throwing during construction and preventing sand blocking.

To achieve the above objective, in accordance with one embodiment of the invention, there is provided a multi-level sliding sleeve of ball-throwing open type comprising an outer cylinder, an inner sliding sleeve, a combined ball socket, a guider, an expander, an upper gland, a lower gland, and a ball. The outer cylinder comprises internal threads in an upper end and external threads in a lower end, and the outer cylinder comprising an external wall comprising a plurality of drainage holes along a peripheral direction. The inner sliding sleeve is mounted to an inner wall of the outer cylinder through shear pins. The inner sliding sleeve comprises a plurality of square holes in the middle along the peripheral direction, each of which is equipped with a ball socket inside. The ball sockets combine together to form the combined ball socket. An inner wall of the combined ball socket comprises a short inclined plane in an upper part and a long inclined plane in a lower part. The combined ball socket is equipped with the guider in the upper end and the expander in the lower end. The guider is an annular solid whose inner wall forms an annular inclined plane capable of guiding the ball to the short inclined plane of the combined ball socket. The guider is equipped with the upper gland in the upper end which is connected to the upper end of the inner wall of the inner sliding sleeve through threaded connection. One end of the upper gland crests to the upper end of the guider and presses the guider closely on the combined ball socket. The external wall of the expander forms an annular front inclined plane in the upper end and fits with the inner wall of the lower gland in the lower end closely. The front inclined plane fits with the long inclined plane closely, and the lower gland is linked to the lower end of the inner wall of the inner sliding sleeve through threaded connection. A spring is placed between the lower gland and the expander. A ring groove matching with the combined ball socket is disposed on the inner wall of the outer cylinder and at the lower part of the combined ball socket.

In a class of this embodiment, each of the drainage holes comprises a temporary buckling which is pressed closely to the drainage hole by a temporary gland.

In a class of this embodiment, a seal ring is arranged in the upper end of the drainage hole and in between the inner sliding sleeve and inner wall of the outer cylinder, in the lower end of the shear pin and in between the inner sliding sleeve and inner wall of the outer cylinder, and in between the guider and inner sliding sleeve.

In a class of this embodiment, upper and lower ends of the inner sliding sleeve are equipped with a set screw; the two set screws both pass through the inner sliding sleeve and reach the flank of thread of the upper and lower glands, respectively.

Advantages of the invention are summarized as follows: The multi-level sliding sleeve of ball-throwing open type can be opened by ball-throwing, and allow the ball to pass through, so during construction, several multi-level sliding sleeves with the same specification can be opened by one ball-throwing, thereby providing the biggest circulation channel for the production in a long segment. In staged fracturing using multi-level sliding sleeve packer, position and quantity of the multi-level sliding sleeve of ball-throwing open type can be selected. The multi-level sliding sleeve of ball-throwing open type can also be used together with the standard sliding sleeve to achieve multi-sectional division, multipoint liquor feeding, and progressive operation in discontinued segments.

DETAILED DESCRIPTION OF THE EMBODIMENTS

For further illustrating the invention, experiments detailing a multi-level sliding sleeve are described below. It should be noted that the following examples are intended to describe and not to limit the invention.

Figure 1:
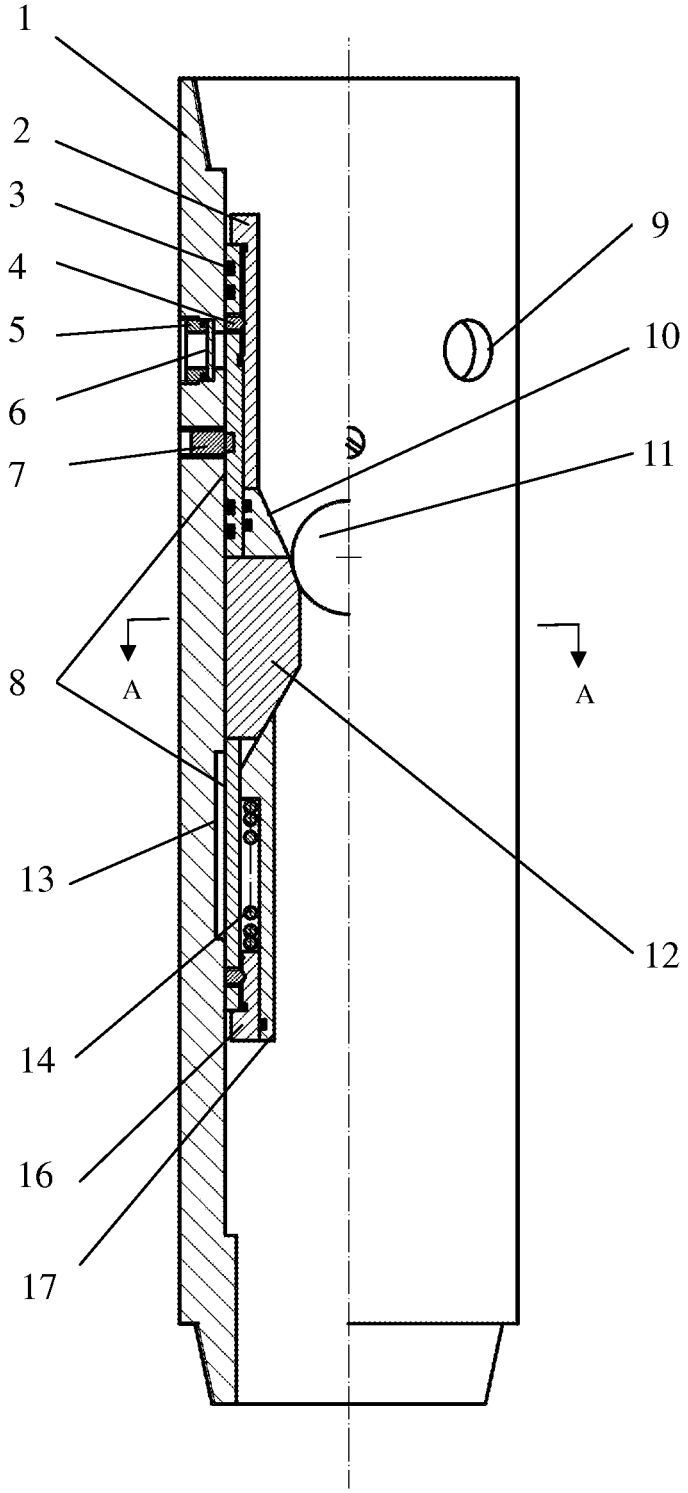
FIG. 1 is a structure diagram of a multi-level sliding sleeve according to one embodiment of the invention.
Figure 2:
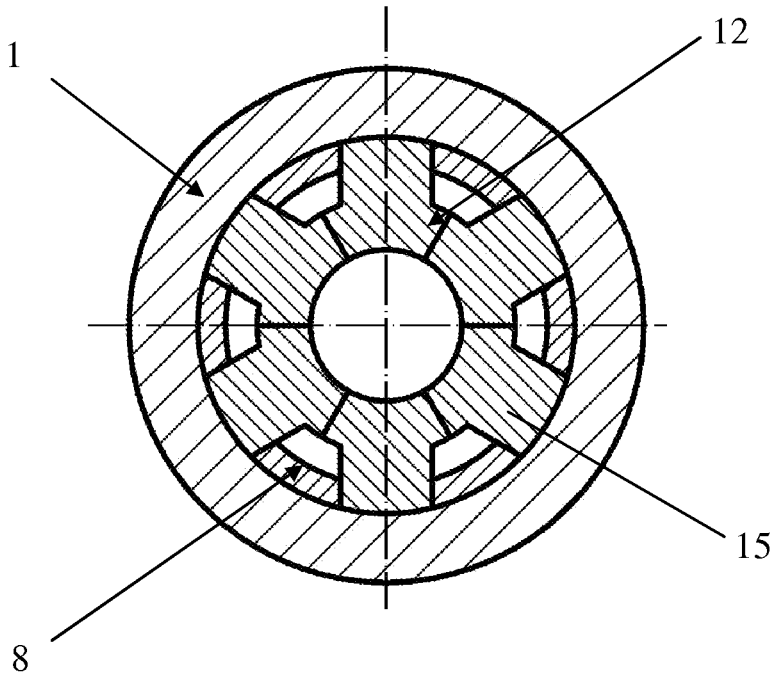
FIG. 2 is a sectional view of a multi-level sliding sleeve of FIG. 1 taken from line A-A direction in a closed state.

As shown in FIG. 1, a multi-level sliding sleeve comprises an outer cylinder 1, an upper gland 2, seal rings 3, a set screw 4, a temporary gland 5, a temporary buckling 6, shear pins 7, an inner sliding sleeve 8, a guider 10, a combined ball socket 12, a groove 13, a spring 14, a lower gland 16, and an expander 17. The outer cylinder 1 is equipped with an upper contact (internal thread) and a lower contact (external thread), which are used to connect the construction pipe mechanism respectively. A plurality of drainage holes are disposed near the upper contact in the peripheral direction. The groove 13 is arranged near the lower contact. The temporary buckling 6 lies inside the drainage hole 9 on the outer cylinder 1 near the upper contact, and is positioned through the step inside the drainage hole 9 and pressed closely by the temporary gland 5. The inner sliding sleeve 8 is mounted to the inner wall of the outer cylinder 1, and is fixed by the inner sliding sleeve 8 and several shear pins 7 uniformly distributed in the peripheral direction. The inner sliding sleeve 8 is equipped with four seal rings 3 inside, two of which are in the upper end of the drainage hole 9, and the other two are under the lower end of the shear pins 7. As shown in FIG. 2, six same ball sockets 15 are mounted in the inner sliding sleeve 8 and are combined to form the combined ball socket 12. The short inclined plane of the combined ball socket 12 faces the upper contact, and the long inclined plane faces the lower contact. The guider 10 is mounted inside the inner sliding sleeve 8 and lies on the upper end of the combined ball socket 12; the lower end face of the guider fits the upper end face of the combined ball socket 12. Two seal rings 3 are placed in between the guider 10 and the inner sliding sleeve 8. The upper gland 2 is fixed to the upper end of the inner sliding sleeve 8 through threads, and the lower end face of the upper gland 2 fits with the upper end face of the guider 10. The set screw 4 passes through the upper end of the inner sliding sleeve 8, and reaches the flank of thread of the upper gland 2. The expander 17 is mounted inside the inner sliding sleeve 8, and its front inclined plane fits with the long inclined plane of the combined ball socket 12. The spring 14 is mounted in between the expander 17 and inner sliding sleeve 8. The lower gland 16 is fit on the lower end of the inner sliding sleeve 8 through threads, and its upper end holds closely with the spring 14. The expander 17 is always contacting with the long inclined plane of the combined ball socket 12 as pushed by the spring 14, thereby giving pressure to the combined ball socket 12 vertical to the axis and facing the outer cylinder 1, allowing the combined ball socket 12 to expand always to the outer cylinder 1 in the radial direction. The set screw 4 passes through the lower end of the inner sliding sleeve 8 and reaches the flank of thread of the lower gland 16.

Figure 3:
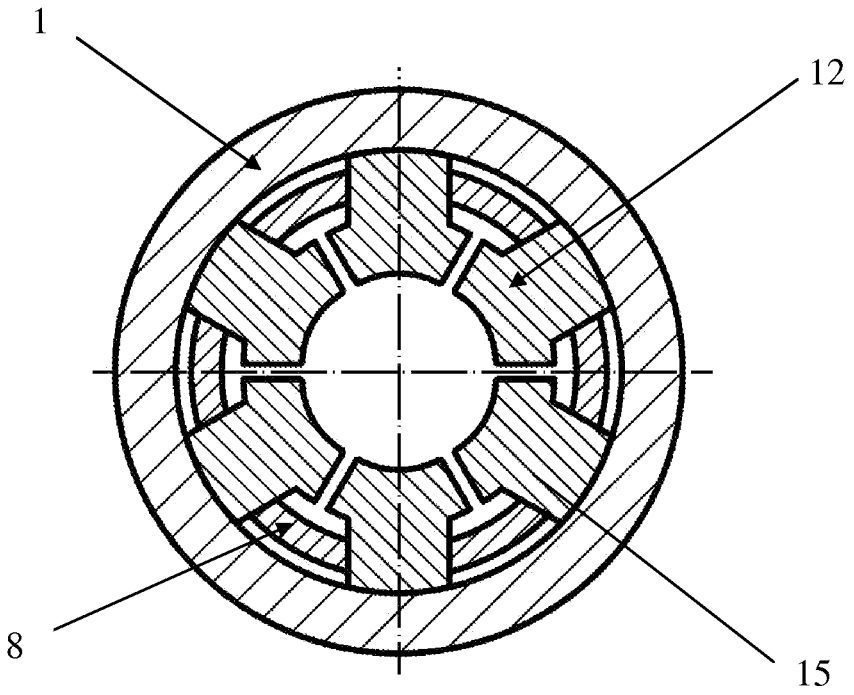
FIG. 3 is a sectional view of a multi-level sliding sleeve of FIG. 1 taken from line A-A direction in an open state.

The multi-level sliding sleeve of ball-throwing open type (hereinafter referred to as the multi-level sliding sleeve) can be operated by throwing the ball 11 to increase the liquid pressure therein. When the sliding sleeve is under the initial inactive state, the ball 11 is thrown in from the upper part thereof and falls over the short inclined plane of the combined ball socket 12 along the annular inclined plane of the guider 10, thereby separating the upper and lower parts inside the multi-level sliding sleeve. As more liquid enters the upper part of the multi-level sliding sleeve, the ball 11 receives increasingly bigger thrust force. When the thrust force goes beyond the breaking limit of the shear pins 7, all uniformly distributed shear pins 7 are cut off, and the inner sliding sleeve 8 and all parts fitted thereon move towards the lower part of the outer cylinder 1 as pushed by the ball 11. In accompany with the relative move of the inner sliding sleeve 8, a pair of seal rings 3 on the upper part of the inner sliding sleeve 8 pass over the drainage holes 9 on the outer cylinder 1, and the temporary buckling 6 is connected to the liquid in the upper part of the multi-level sliding sleeve. When the combined ball socket 12 moves to the position of the groove 13 of the outer cylinder 1, the combined ball socket 12 expands radially and moves inside the groove 13 under the thrust force of the expander 17, and the diameter of the inner bore formed by the combined ball socket 12 becomes bigger, as shown in FIG. 3. As the combined ball socket 12 expands, the ball 11 which is originally restricted by the bore diameter is free and flows to the lower part of the outer cylinder 1 together with the liquid, and flows to the lower apparatus finally. Before the fracturing operation, liquid pressure inside the multi-level sliding sleeve rises gradually. When the pressure rises to the limit value of the temporary buckling 6, the temporary buckling 6 on the outer cylinder 1 fractures, and the internal and external parts of the multi-level sliding sleeve are communicated. Thus the multi-level sliding sleeve is completely opened.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A multi-level sliding sleeve, comprising:

a) an outer cylinder;

b) an inner sliding sleeve;

c) a combined ball socket;

d) a guider;

e) an expander;

f) an upper gland;

g) a lower gland; and h) a ball;

wherein the outer cylinder comprises internal threads in an upper end and external threads in a lower end;

the outer cylinder comprises an external wall comprising a plurality of drainage holes along a peripheral direction;

the inner sliding sleeve is mounted to an inner wall of the outer cylinder through shear pins;

the inner sliding sleeve comprises a plurality of square holes in the middle along the peripheral direction, each of which is equipped with a ball socket inside, and the ball sockets combine together to form the combined ball socket;

an inner wall of the combined ball socket comprises a short inclined plane in an upper part and a long inclined plane in a lower part;

the combined ball socket is equipped with the guider in the upper end and the expander in the lower end; the guider is an annular solid, an inner wall of which comprises an annular inclined plane capable of guiding the ball to the short inclined plane of the combined ball socket; the guider is equipped with the upper gland in the upper end which is connected to the upper end of the inner wall of the inner sliding sleeve through threaded connection;

one end of the upper gland crests to the upper end of the guider and presses the guider on the combined ball socket; the external wall of the expander comprises an annular front inclined plane in the upper end and fits with the inner wall of the lower gland in the lower end;

the front inclined plane fits with the long inclined plane, and the lower gland is linked to the lower end of the inner wall of the inner sliding sleeve through threaded connection;

a spring is placed between the lower gland and the expander; and a ring groove matching with the combined ball socket is disposed on the inner wall of the outer cylinder at the lower part of the combined ball socket.

2. The multi-level sliding sleeve of claim 1, wherein each of the drainage holes comprises a temporary buckling which is pressed to the drainage hole by a temporary gland.

3. The multi-level sliding sleeve of claim 1, wherein a seal ring is arranged in the upper end of the drainage hole and in between the inner sliding sleeve and inner wall of the outer cylinder, in the lower end of the shear pin and in between the inner sliding sleeve and inner wall of the outer cylinder, and in between the guider and inner sliding sleeve.

4. The multi-level sliding sleeve of claim 1, wherein upper and lower ends of the inner sliding sleeve are equipped with a set screw; the two set screws both pass through the inner sliding sleeve and reach the flank of thread of the upper and lower glands, respectively.

* * * * *